US006062179A

United States Patent [19]

Gohara et al.

[11] Patent Number: 6,062,179

[45] Date of Patent: May 16, 2000

[54] FUEL-INCREASING SYSTEM FOR AN ENGINE

[75] Inventors: Yoshihiro Gohara; Hiroaki Fujimoto; Masayoshi Nanami, all of Hamamatsu, Japan

[73] Assignee: Sanshin Kogyo Kabushiki Kaisha, Hamamatsu, Japan

[21] Appl. No.: 09/022,646

[22] Filed: Feb. 12, 1998

Related U.S. Application Data

[63] Continuation of application No. 08/706,670, Sep. 6, 1996, Pat. No. 5,749,338.

[30] Foreign Application Priority Data

Sep. 6, 1995 [JP] Japan ..... 7-229346

[51] Int. Cl.[7] ..... F02B 33/04

[52] U.S. Cl. ..... 123/73 A; 123/DIG. 5; 261/34.2

[58] Field of Search ..... 123/73 A, DIG. 2, 123/DIG. 5; 261/34.2

[56] References Cited

U.S. PATENT DOCUMENTS

| | | | |
|---|---|---|---|
| 3,628,516 | 12/1971 | Perrin et al. . | |
| 4,088,102 | 5/1978 | Kato | 261/34.2 |
| 4,278,618 | 7/1981 | Higashigawa et al. | 261/34.2 |
| 4,312,314 | 1/1982 | McChesney et al. | 261/34.2 |
| 4,481,914 | 11/1984 | Ishida . | |
| 4,671,220 | 6/1987 | Inoue et al. . | |
| 4,957,664 | 9/1990 | Kohno et al. . | |
| 5,018,503 | 5/1991 | Hoshiba et al. . | |
| 5,240,649 | 8/1993 | Yamada et al. . | |
| 5,241,931 | 9/1993 | Radel | 123/179.14 |

*Primary Examiner*—Noah P. Kamen
*Attorney, Agent, or Firm*—Knobbe, Martens, Olson & Bear LLP

[57] ABSTRACT

A method and device for increasing the amount of fuel to an engine during acceleration is provided. A secondary source of fuel in addition to a first source of fuel is introduced into the engine during acceleration. The secondary source of fuel is introduced through a secondary fuel delivery line which is opened by a valve actuated in response to throttle control movement. In a first embodiment, the secondary fuel delivery line communicates with a fuel delivery area from which fuel is supplied to the first fuel source. The valve is pressed open by the throttle control along with a primary fuel source needle valve control, allowing fuel from the fuel delivery area to flow through the second fuel line in addition to the first fuel source. In second and third embodiments, the secondary fuel line communicates with an excess fuel return line. A valve extends across the fuel return line and secondary fuel line. The valve is movable between a closed position in which the fuel return line is open and the secondary fuel line obscured, and an open position in which the fuel return line is blocked and fuel is diverted to the secondary fuel line. In the second embodiment, the valve is moved by a control rod connected to a rotatable linkage connected to the throttle control. In the third embodiment, the valve is opened by movement of a vacuum operated diaphragm device.

10 Claims, 10 Drawing Sheets

FUEL-INCREASING SYSTEM FOR AN ENGINE

RELATED APPLICATIONS

This application is a continuation of U.S. patent application Ser. No. 08/706,670 filed Sep. 6, 1996, now U.S. Pat. No. 5,749,338, which claims priority to Japanese Application 7-229346 filed Sep. 6, 1995.

FIELD OF THE INVENTION

The present invention relates to a method and device for increasing the amount of fuel supplied to an engine.

BACKGROUND OF THE INVENTION

It has been found desirable in many instances to provide engines with a leaner than normal air/fuel mixture. Providing an engine with a lean air/fuel mixture is satisfactory in many running conditions, such as when the engine is idling, but does not provide sufficient fuel to support engine acceleration.

By way of example, a two-stroke engine creates exhaust gases, some of which mix in the scavenging process with the incoming air/fuel charge. These exhaust gases may contaminate the fresh incoming charge to an extent that complete combustion is prevented. The engine's power is reduced, and incomplete combustion of that charge further results in the engine's creation of exhaust which is highly polluted, aggravating the scavenging problem.

Also, during the scavenging process some of the fresh air/fuel charge is exhausted with the exhaust gases. The exhausting of unburned fuel in the air/fuel charge with the exhaust gases lowers the engine's power and contributes to air pollution.

In order to reduce these problems, the rate at which fuel is supplied to the engine is reduced. Combustion of this relatively lean fuel mixture produces a less polluted exhaust gas, reducing the contamination of the incoming air/fuel charge. Also, the lean air/fuel mixture which is exhausted contains less unburned fuel to pollute the atmosphere.

Providing fuel at a reduce rate is satisfactory when the engine does not require a great deal of fuel, such as when the engine is idling. However, when the engine speed accelerates, this solution is unsatisfactory since insufficient fuel is provided to the engine.

For example, planing-type watercraft require a greater amount of engine power to move them from their trolling (or resting) position to their planing position, than is required to maintain the watercraft's trolling or planing velocity. In certain types of boats, especially those known as personal watercraft, a problem arises in obtaining the necessary engine power to plane the boat using engines of the type described above.

A method and device for increasing the amount of fuel delivered to an engine during times of engine acceleration, while maintaining a low fuel delivery rate to the engine at other times, is desirable.

SUMMARY OF THE INVENTION

In accordance with the present invention, a fuel-increasing system is provided for increasing the amount of fuel delivered to engine during acceleration, while maintaining a low fuel delivery rate to the engine at other times. Preferably, the fuel-increasing system comprises providing a secondary fuel source in addition to the primary fuel source for the engine, and delivering fuel with the secondary fuel source to the engine during times of acceleration.

In a first embodiment, the system includes a secondary fuel delivery line which extends from a primary fuel delivery chamber to an air flow passage within the carburetor of the engine. A valve is positioned within the secondary fuel delivery line. The valve is biased into a position in which a first end of the valve closes the line during normal engine operation.

A second end of the valve is mounted adjacent the end of an actuating arm connected to a needle valve controlling the amount of fuel introduced into the fuel chamber and subsequently delivered through the first fuel source of the engine. When the engine's throttle control is moved to the open or acceleration position, it presses upon the arm. The arm, in turn, presses upon the valve, opening it and allowing a secondary amount of fuel in addition to that introduced by the primary fuel source to be added to the air charge entering the engine.

In a second embodiment of the present invention, a secondary fuel delivery line extends from a fuel return line for the primary fuel source to the intake of the engine. A valve is movably positioned across the fuel return line and secondary fuel delivery line. First and second apertures extend through the valve. The valve is biased into a first position in which it obscures the secondary fuel delivery line, but has its second aperture aligned with the fuel return line. During normal engine operation, the engine receives fuel from only the primary fuel source, and excess fuel is routed through the fuel return line to the fuel tank.

In a second position, during acceleration conditions, the valve is moved so that it obscures the fuel return line. Excess fuel is diverted to the secondary fuel delivery line and passes through the first aperture in the valve and into the air charge provided to the engine.

In this embodiment, the valve is moved into the second or "acceleration" position by movement of a rotating actuator. The actuator is connected to the valve with a connector rod, with the actuator in turn operated by the throttle control. Movement of the throttle to the open or acceleration position rotates the actuator, pulling the connector rod, and the valve connected thereto, downwardly into the second position.

In a third embodiment, a valve arrangement similar to that of the second embodiment is instead actuated by a vacuum actuation device. The vacuum actuation device comprises a body having an interior chamber in which is mounted a diaphragm. The diaphragm is connected via a rod to the valve. The chamber is connected via a hollow tube to the intake of the engine.

The valve is biased with a spring into the position in which it obscures the secondary fuel delivery line. When the throttle is opened and the pressure within the intake increases, the diaphragm moves, pulling the valve downwardly until the valve is in its second position with the first aperture aligned with the secondary fuel delivery line.

In accordance with the present invention, an additional amount of fuel beyond that normally delivered by the primary fuel source is provided to the engine. Preferably, this additional fuel is delivered to the engine when the throttle is opened inducing engine acceleration, such as during that time the watercraft is accelerating from trolling velocity to planing velocity.

Fuel delivery to the engine with the system of the present invention may be increased in direct response to the mechanical movement of the throttle control via linkages such as that described above. In addition, however, the system of the present invention may be modified to include an acceleration detecting means. The acceleration detecting means may be connected to the throttle and utilize the position of the throttle for determining the desired engine speed. If the movement of the throttle is substantial and exceeds a predetermined calculated change in velocity, the acceleration detector activates the fuel-increasing system of the present invention to add additional fuel to the engine. The acceleration detection means may be programmed to activating the fuel-increasing system sometime after the throttle is opened and/or leave the system on sometime after the throttle is closed.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
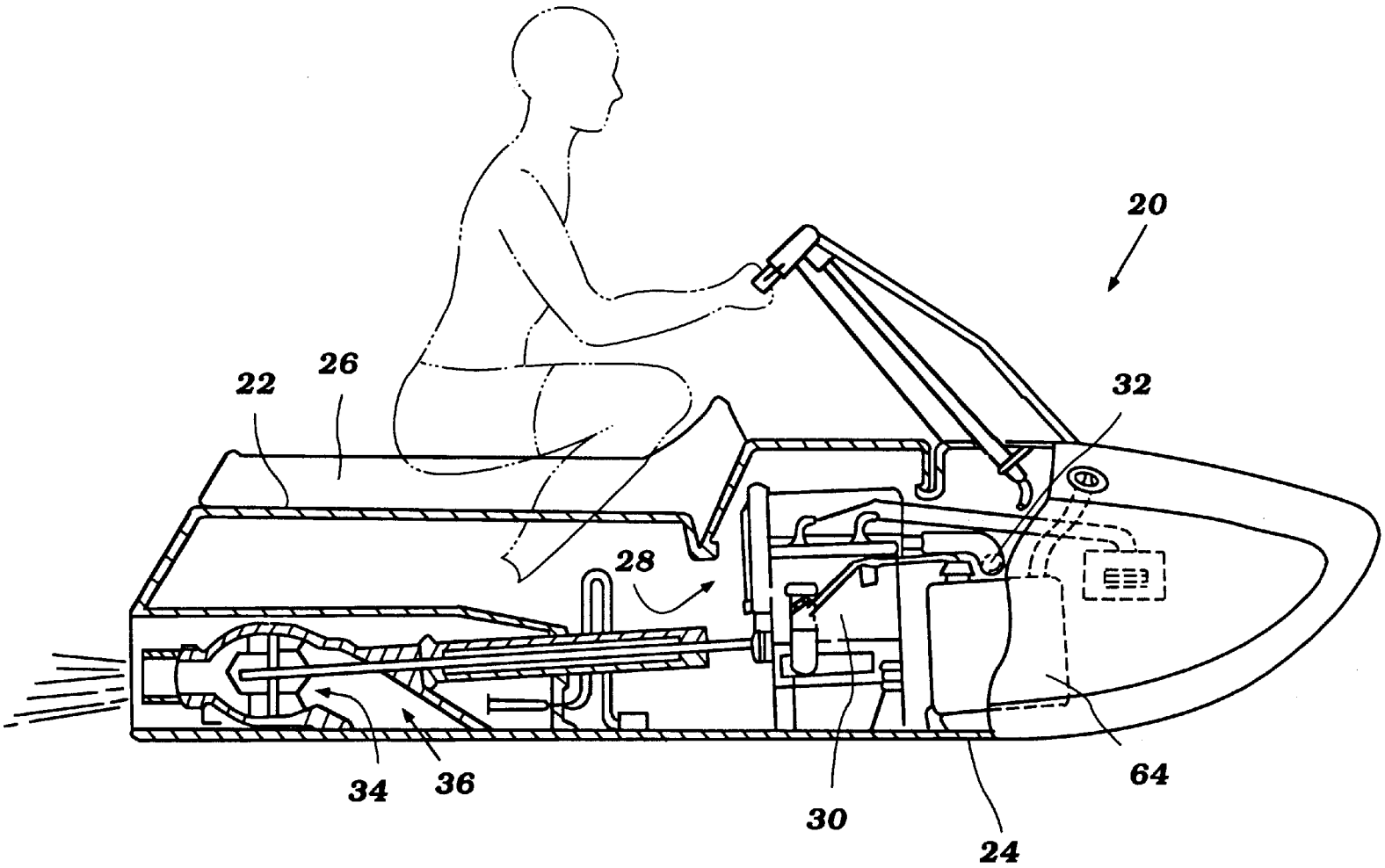
FIG. 1 is a partial cut-away side view of a planing-type watercraft having an engine with which the present invention is utilized.

FIG. 1 illustrates a planing type watercraft 20 of the type with which the fuel-increasing system of the present invention is useful. These types of watercraft or boats 20 are well known and thus will not be described in detail herein. In general, however, these watercraft 20 have a deck 22 connected to a hull 24. A seat 26 on which a rider sits is mounted on the deck 22.

Figure 2:
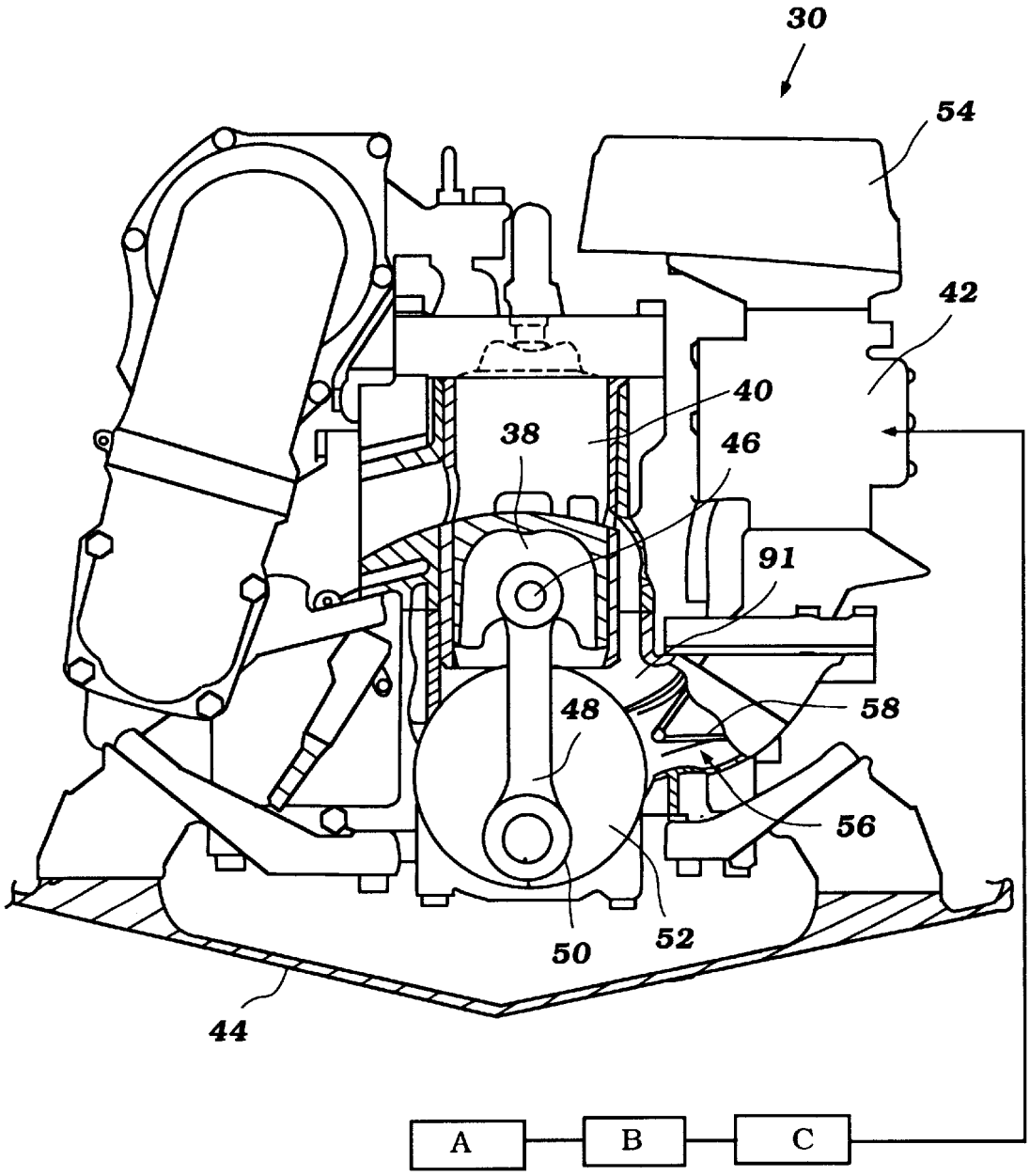
FIG. 2 is a sectional view of the engine utilized with the planing-type watercraft illustrated in FIG. 1.

The deck 22 and hull 24 define therein a engine compartment 28. Within the engine compartment 28 is mounted an engine 30. As illustrated in FIG. 2, this engine 30 is normally of the two-stroke variety. Referring again to FIG. 1, an air inlet 32 is provided in the hull 24 for providing fresh air into the engine compartment 28. Fuel is supplied to the engine 30 from a fuel tank 60.

The engine 30 drives an impeller 34 positioned with a water intake passage 36. The impeller 34 draws water through the intake passage 36 and expels it out the rear of the craft, propelling the craft 20.

FIG. 2 illustrates the type of engine 30 with which the fuel-increasing system of the present invention is preferably utilized. While this is the preferred type of engine with which the method and device of the present invention are utilized, it should be understood that the method and device are useful in a variety of types and sizes of engines. Further, an engine including the system of the present invention may be utilized in conjunction with other than planing watercraft.

As illustrated, the engine 30 includes a cylinder block assembly 44 having at least one piston bore 40 therein. A piston 38 is mounted for reciprocation within each cylinder bore 40, each piston connected by means of a pin 46 to a connecting rod 48. Each connecting rod 48 has its lower end journalled on a throw of a crankshaft 50, the crankshaft 50 being rotatably mounted within a crankcase chamber 52 formed in the lower portion of the cylinder block 44. As is well known in the art, where there are multiple cylinders, the crankcase chamber associated with each cylinder is sealed from the others so facilitate the two cycle crankcase compression operation of the engine 30.

An intake air charge is drawn from the engine compartment 28 (See FIG. 1) into the crankcase chamber 52 through an induction system. This induction system generally includes an intake manifold 54 that draws air through an air inlet, and delivers it to an intake passage 56 formed at a lower portion of the cylinder block 44 and which communicates with the crankcase chamber 52. A reed type vale assembly 58 is provided in the intake passage 56 so as to permit the flow of the intake charge into the crankcase chamber when the piston 38 moves upwardly in the cylinder bore 40, and for precluding reverse flow when the piston 38 is moving downwardly so as to compress the charge in the crankcase chamber 52.

The charge which is delivered through the intake passage 56 is an air/fuel mixture. In particular, as the air charge is drawn into the engine 30, fuel is added to it from a primary fuel source within a carburetor 42.

Figure 6:
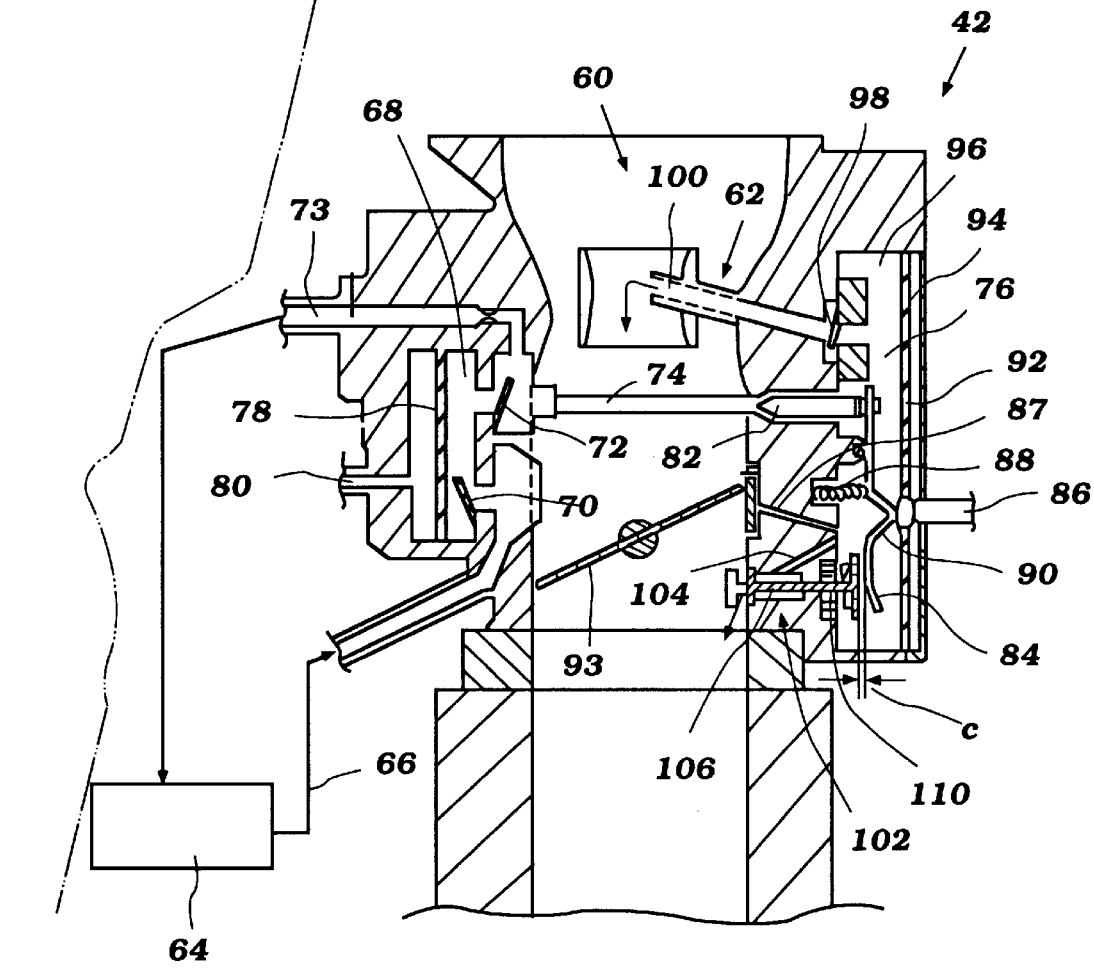
FIG. 6 is a sectional view illustrating a first embodiment fuel-increasing system for an engine in accordance with the present invention.

The carburetor 42 may have any number of a variety of configurations. FIG. 6 illustrates a specific embodiment carburetor 42 with which the fuel-increasing method and system of the present invention are particularly useful. As illustrated therein, the carburetor 42 includes an air flow passage 60 therethrough, the first end of which is connected to the intake manifold 54 of the engine the second end of which leads to the air/fuel intake passage 56 of the engine. The air flow passage 60 includes a restricted area or venturi through which incoming air passes.

The carburetor 42 includes a first or primary fuel supply for mixing with the air passing through the air flow passage 60. The primary fuel supply is introduced at the venturi 62 to obtain maximum mixing of the air and fuel.

The primary source of fuel is provided by a fuel pump (not shown) from a fuel tank 64 through a fuel line 66 to a first chamber 68. The fuel passes through a check valve 70 when entering the first chamber 68. The fuel is then metered through a second check valve 72 through a second fuel line 74 to a fuel delivery chamber 76.

A air pressure driven diaphragm 78 controls movement of the fuel in and out of the first chamber 68. In particular, the diaphragm 78 is mounted in the chamber 68 such that air moves in and out of the chamber on one side of the diaphragm, while fuel fills the opposite side of the chamber. A pulsating air source from the engine crankcase is provided through an air line 80 extending in communication with the portion of the chamber 68 behind the diaphragm 78. When the air pressure behind the diaphragm 78 is reduced, the fuel pressure generated by the fuel pump causes fuel to pass through the first check valve 70 and into the portion of the first chamber 68 in front of the diaphragm 78. At this same time, fuel is prevented from leaving the chamber 68 by the second check valve 72, which is biased into a closed position.

When the air pressure behind the diaphragm 78 increases, the diaphragm extends inwardly. As the pressure within the portion of the chamber 68 in which the fuel is positioned increases, the first check valve 70 closes, preventing further inlet of fuel. At the same time, the increased pressure causes the second check valve 72 to open, allowing fuel to pass through the second fuel line 74 to the fuel delivery chamber 76.

The rate at which fuel is delivered into the fuel delivery chamber 76 is controlled, at least in part, by a needle valve 82 positioned within the line 74. This needle valve 82 is connected, via a linkage arm 84, to the throttle control 86. The arm 84 extends outwardly from the needle valve 82 some distance beyond a rotational mounting. A spring 88 biases the needle valve 82 into a closed position, i.e. one where the valve 82 substantially blocks the second fuel line 74, preventing fuel from entering the fuel delivery chamber 76.

The portion of the arm 84 extending beyond the rotational mounting includes an outwardly extending protrusion or boss 90 for abutment against an end of the throttle control 86. The throttle control 86 is configured such that it presses against the boss 90 when the user of the craft 20 desires to accelerate, thus causing the needle valve 82 to move out of the second fuel line 74, permitting more fuel to flow therethrough.

Fuel which is delivered into the fuel line 74 from the first chamber 68 but which is precluded from entering the fuel delivery chamber 76 by the needle valve 82 returns to the fuel tank 64 by a fuel return line 73.

Fuel which is delivered to the fuel delivery chamber 76 is subsequently introduced into the incoming air stream so as to create an air/fuel mixture. In particular, a diaphragm 92 is mounted within the fuel delivery chamber 76. The diaphragm 92 divides the chamber into an atmospheric area 94, and a fuel storage area 96. When the second check valve 72 closes, the atmospheric pressure exceeds the fuel pressure, and the diaphragm 92 moves inwardly. At nearly closed throttle positions, increasing pressure on the fuel forces the fuel through a small passage 87 into the air passage 60. When the throttle plate is opened, the air pressure causes the fuel to pass through a third check valve 98 and along a fuel delivery path to a delivery orifice 100 positioned within the venturi 62 of the air flow passage 60.

In accordance with the present invention, the engine 30 further includes a fuel-increasing system, whereby the amount of fuel provided to the engine is increased when required, such as during periods of acceleration. In accordance with a first embodiment of the present invention, this fuel-increasing system comprises a secondary fuel addition system, generally labeled 102.

This secondary fuel addition system 102 comprises a secondary fuel delivery line 104 and a valve 106 for selectively opening and closing the line. Preferably, the secondary fuel delivery line 104 extends from the lower portion of the fuel delivery chamber 76 through the wall of the carburetor 42 to a point within the air flow passage 60. As illustrated in FIG. 6, the point where the secondary fuel delivery line 104 enters the passage 60 is located downstream of the throttle plate 93.

The valve 106 is biased with a spring 110 into a position where a head portion of the valve 106 obstructs the fuel line 104. The valve 106 further includes an enlarged end opposite its head for engagement by the portion of the needle valve control arm 84. Preferably, when the valve 106 is in its static state, the enlarged end of the valve 106 and the arm 84 are separated by a distance "C." This distance "C" permits the throttle control 86 to be pressed inwardly so as to increase fuel delivery to the engine 30 without invoking the fuel-increasing system of the present invention, such as in situations where it is intended to increase the engine speed only slightly. In particular, the control 86 may be pressed inwardly the distance "C", thus moving the needle valve 82 so as to increase the fuel delivery rate, without triggering the secondary fuel adding system.

In situations where high acceleration is required, however, sufficient inward movement of the throttle control 86 presses the valve 106 open, allowing a secondary amount of fuel to flow into the air source in addition to the first or primary source of fuel. The delivery of the secondary source of fuel enriches the air/fuel mixture, allowing the engine to generate the greater power necessary to accelerate the craft 20 to its planing position.

Figure 7:
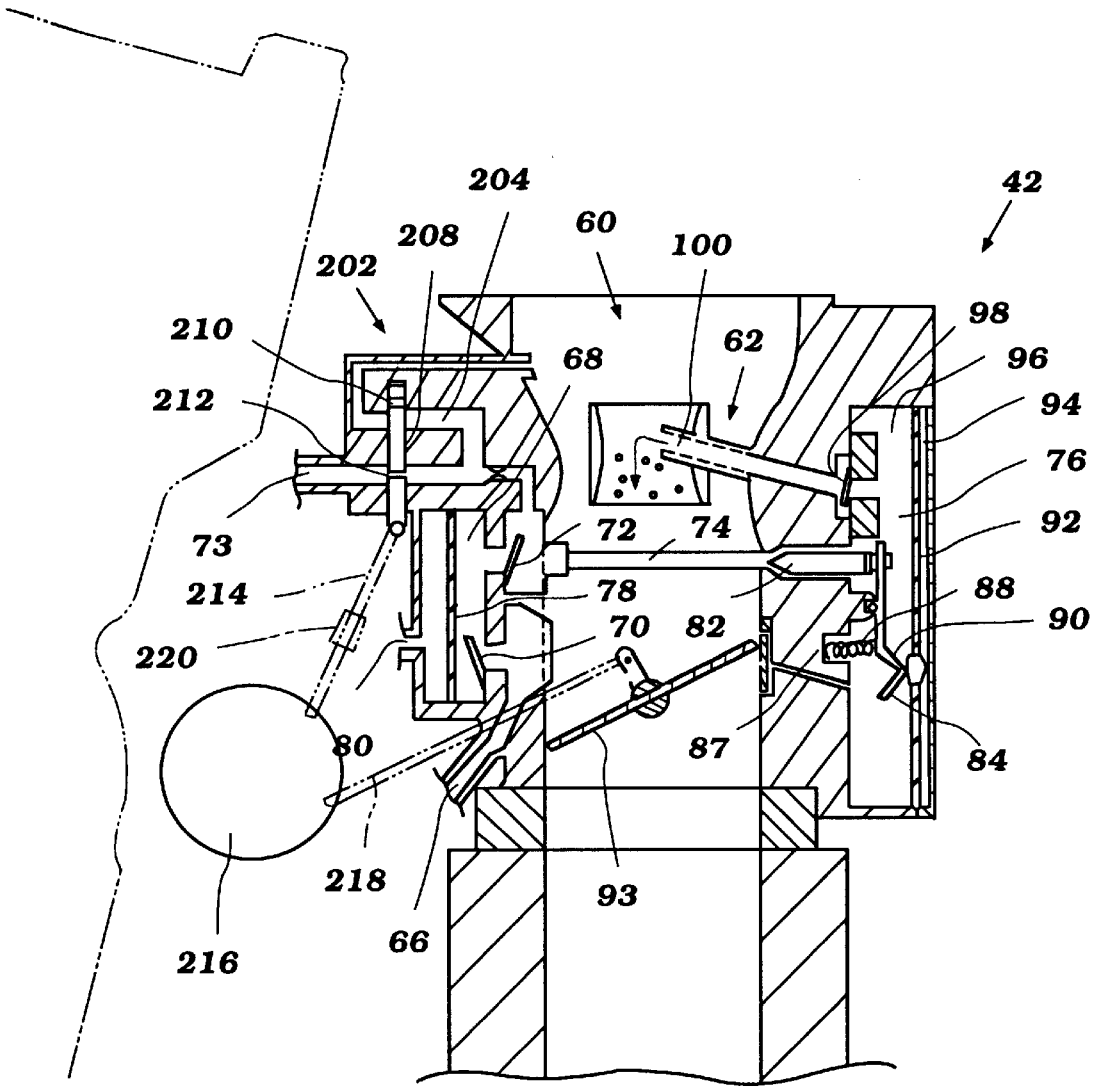
FIG. 7 is a sectional view illustrating a second embodiment fuel-increasing system in accordance with the present invention, where the system includes a secondary valve and the valve is illustrated in a closed position.
Figure 8:
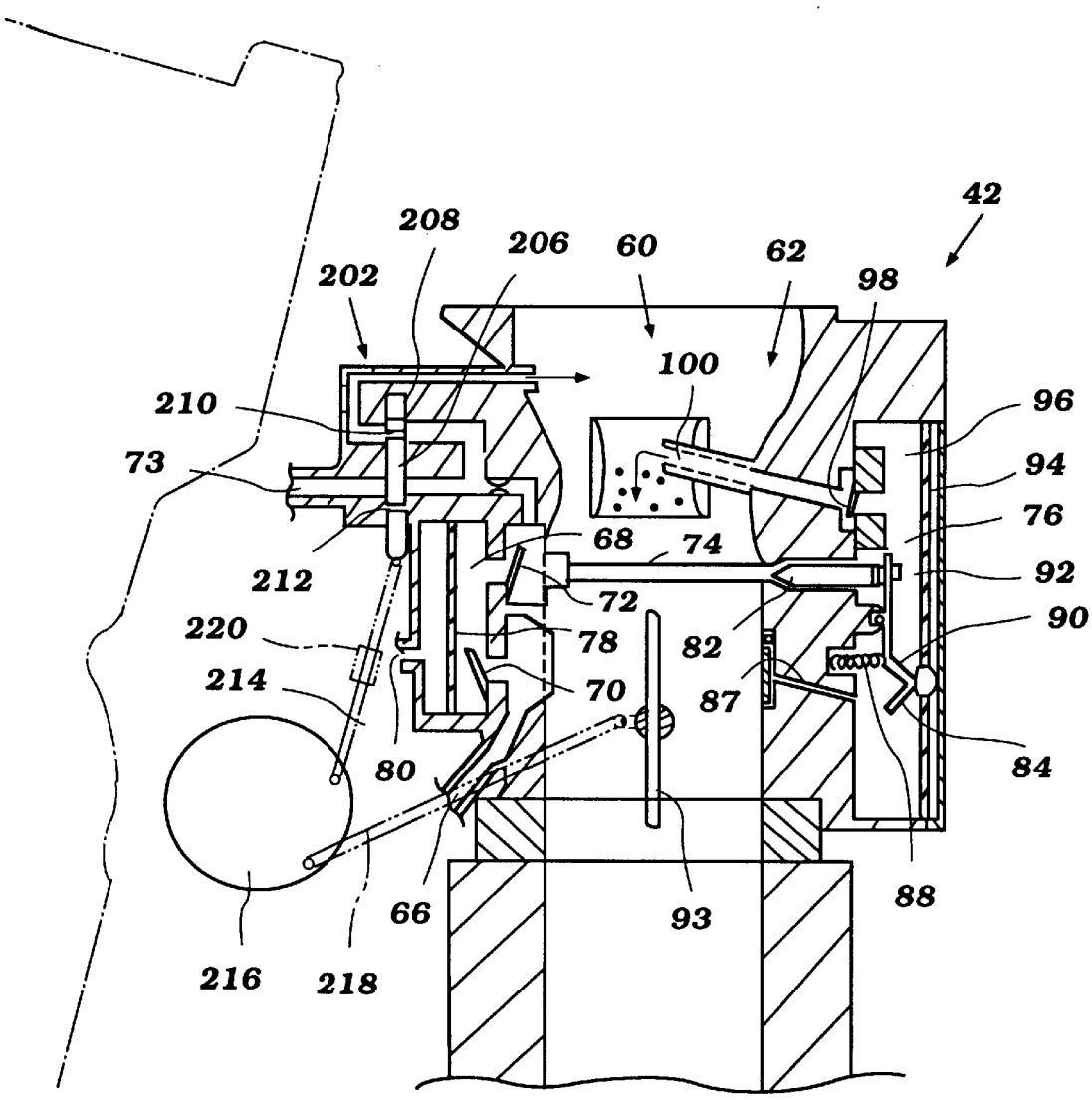
FIG. 8 is a sectional view similar to that illustrated in FIG. 7, with the secondary valve illustrated in the open position.

FIGS. 7 and 8 illustrate a second embodiment fuel-increasing system in accordance with the present invention, generally labeled 202. In general, this system 202 is useful with the type of carburetor 42 with which the first embodiment system 102 was described above.

The second embodiment fuel-increasing system 202 comprises a secondary fuel delivery line 204 and valve 206 for selectively opening and closing the line 204. As illustrated, the secondary fuel delivery line 204 preferably extends from the fuel return line 73 to a point in the air flow passage 60 above the venturi 62.

The valve 206 is movably mounted in a passage 208 which extends across the fuel return line 73 and the secondary fuel delivery line 204. The valve 206 has a first aperture 210 and a second aperture 212 extending therethrough for selective alignment with the fuel return line and secondary fuel delivery lines 73,204, respectively.

Means are provided for moving the valve 206 between a first position in which it closes the secondary fuel delivery line 204, and a second position in which the line 204 is open. In this embodiment, the means preferably comprises a rotatable actuator 216 connected to the engine throttle control.

The valve 206 is connected via a connecting rod 214 to the actuator 216. The actuator 216 is preferably a circular body rotatably connected to the throttle control and arranged such that movement of the throttle control effectuates rotation of the actuator 216. The actuator 216 is further connected by an arm 218 to the throttle plate 93 positioned within the air flow passage 60 of the carburetor 42. In order to reduce movement of the valve 206 which might be caused by transmission of vibrations through the rod 214, a dampener 220 is preferably positioned along the rod 214.

The lengths of the rod 214 and arm 218 and the position of the apertures 210,212 in the valve 206 are selected so that the valve 206 functions as follows. In a first position, as illustrated in FIG. 7, when the engine 30 is idling or slowing accelerating, the valve 206 obstructs the secondary fuel delivery line 104. At the same time, the second aperture 212 is aligned with the fuel return line 73, causing excess fuel to return to the fuel tank 64. When the actuator 216 is in this position, the throttle plate 93 is only partially open, and the primary fuel source provides the fuel necessary for the engine 30.

Upon movement of the throttle control to an acceleration position, the actuator 216 rotates to a second position. In this position, illustrated in FIG. 8, the valve 206 is moved downwardly to a position in which the first aperture 210 in the valve 204 is aligned with the secondary fuel delivery line 204. At the same time, the valve 206 obstructs the fuel return line 73. This causes excess fuel delivered into the second fuel line 74 to be routed to the secondary delivery line 204 and introduced into incoming air stream in the air flow passage 60 in the carburetor 42. At the same time, rotation of the actuator 216 causes the arm 218 to move the throttle plate 93 into an open position.

Figure 9:
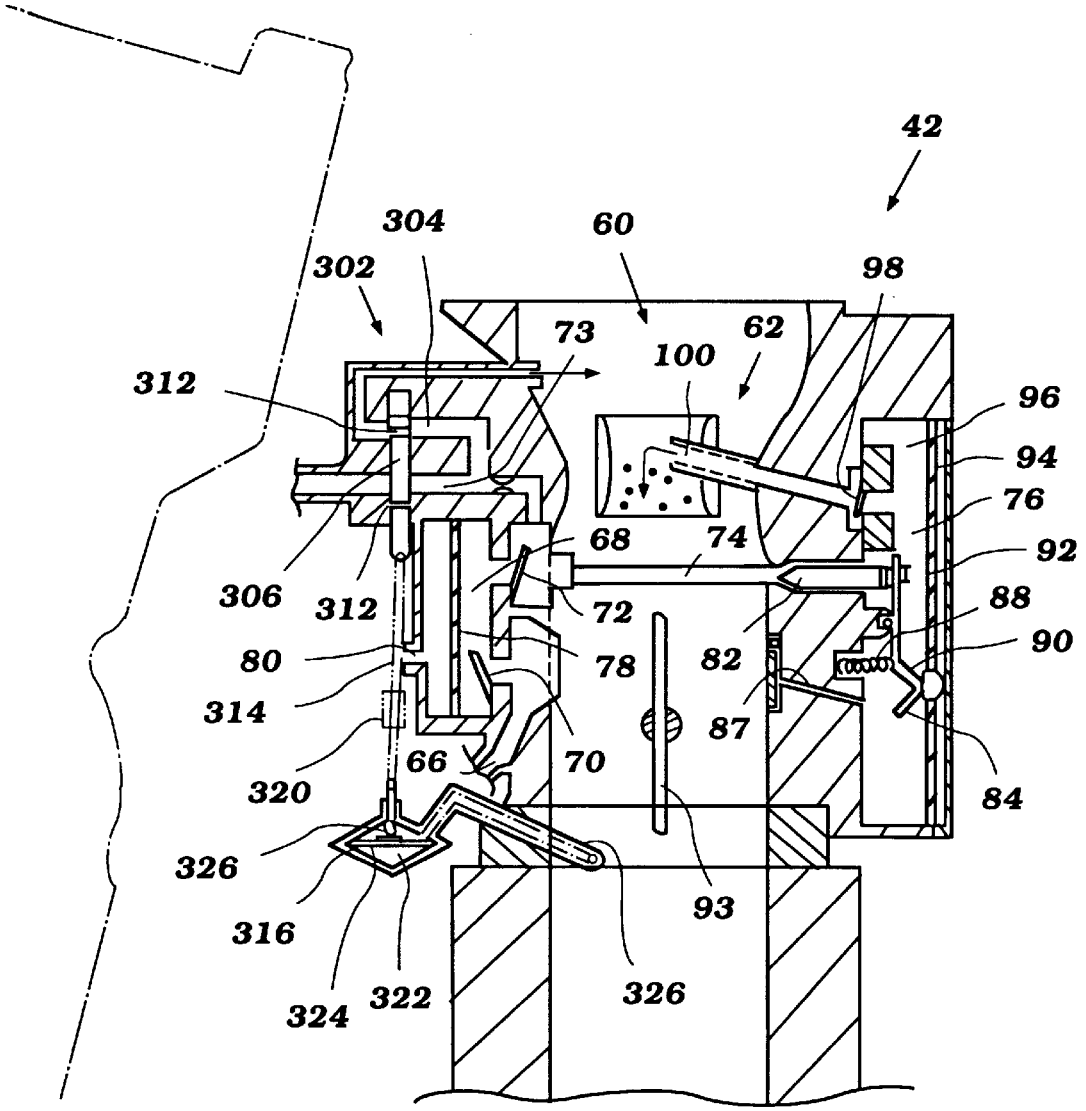
FIG. 9 is a sectional view illustrating a third embodiment fuel-increasing system in accordance with the present invention.

FIG. 9 illustrates a third embodiment fuel-increasing system 302 in accordance with the present invention. This system 302 is preferably utilized with carburetor 42 similar to that described for use with the first and second embodiments of the system 102,202 of the present invention.

The third embodiment fuel-increasing system 302 is similar to the second embodiment system 202 illustrated in FIGS. 7 and 8. The third embodiment fuel-increasing system 302 includes a secondary fuel delivery line 304 and valve 306 similar to the line 204 and valve 204 described above. The valve 306 includes a first aperture 310 and a second aperture 308 therethrough.

In this embodiment, the means for actuating the valve 306, however, is different than that of the second embodiment fuel-increasing system 202. In this embodiment, the means for actuating the valve 306 comprises a vacuum operated actuator 316 connected to the valve 306 via a connecting rod 314. Once again, to reduce the possibility of movement of the valve 306 as a result of vibration transmission along the rod 314, a dampener 320 is positioned along the length of the rod 314.

The vacuum operated actuator 316 has an interior chamber 322 in which is mounted a diaphragm 324. The connecting rod 314 extends into the chamber 322 and is connected to the diaphragm 324. A spring 326 connected to the diaphragm 324 and the chamber 322 biases the diaphragm 324 (and thus the valve 306) upwardly. In this position, the vacuum operated actuator 316 retains the valve 306 in a position in which it obscures the secondary fuel delivery line 304 (see FIG. 7), and wherein the second aperture 312 therein is aligned with the fuel return line 73.

A hollow tube 328 connects the chamber 324 of the vacuum operated actuator 316 with the air flow passage 60 of the carburetor 42, preferably downstream of the throttle plate 93.

When the engine 30 is idling or during periods of low acceleration, the valve 306 is biased into a position in which it obscures the secondary fuel delivery line 304. When, however, the throttle control is actuated and the throttle plate 93 opens, increased air pressure is transmitted through the tube 328 causing the diaphragm 322 to move downwardly. This, in turn moves the connecting rod 314, and thus the valve 306, downwardly into the position illustrated in FIG. 9. In this position, the first aperture 310 in the valve 306 is aligned with the secondary fuel delivery line 304. At the same time the valve 306 obscures the fuel return line 73. Fuel passes through the secondary fuel delivery line 304, where it is delivered to the air stream passing through the air flow passage 60 in the carburetor 42 in addition to the fuel added by the primary fuel source.

Figure 10:
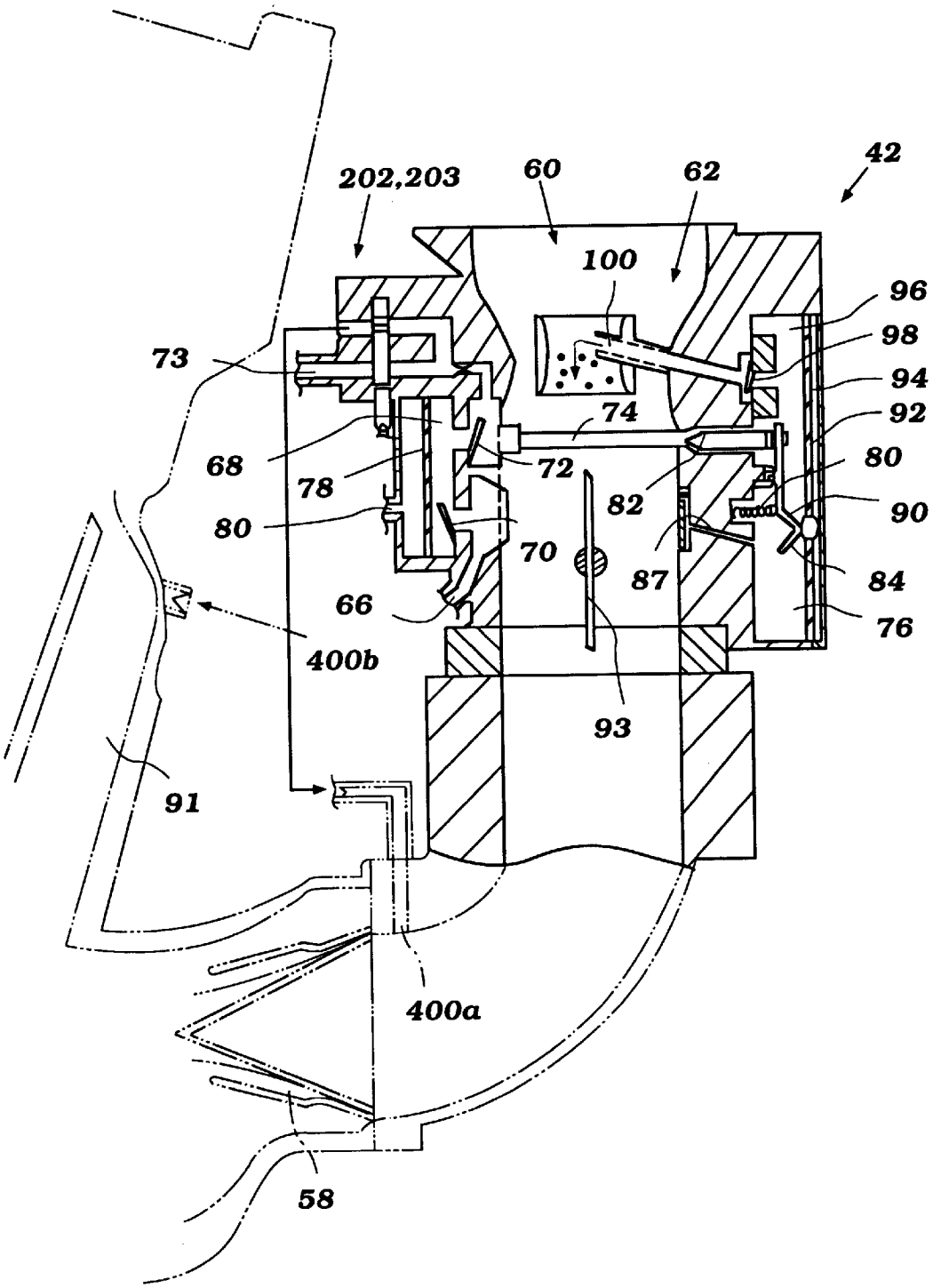
FIG. 10 is a sectional view of an engine illustrating a number of points at which fuel may be added to the engine with a fuel-increasing system of the present invention.

FIG. 10 illustrates some of the numerous points of the engine 30 at which fuel provided by the fuel-increasing system of the present invention may be introduced. In addition to those points illustrated in FIGS. 6–9, the secondary fuel source may be introduced at a point 400*a* which is located adjacent, but slightly upstream of, the reed valve 58. Alternatively, the secondary fuel source may be introduced at a point 400*b* located in one of the scavenging passages 91 of the engine 30.

Figure 3:
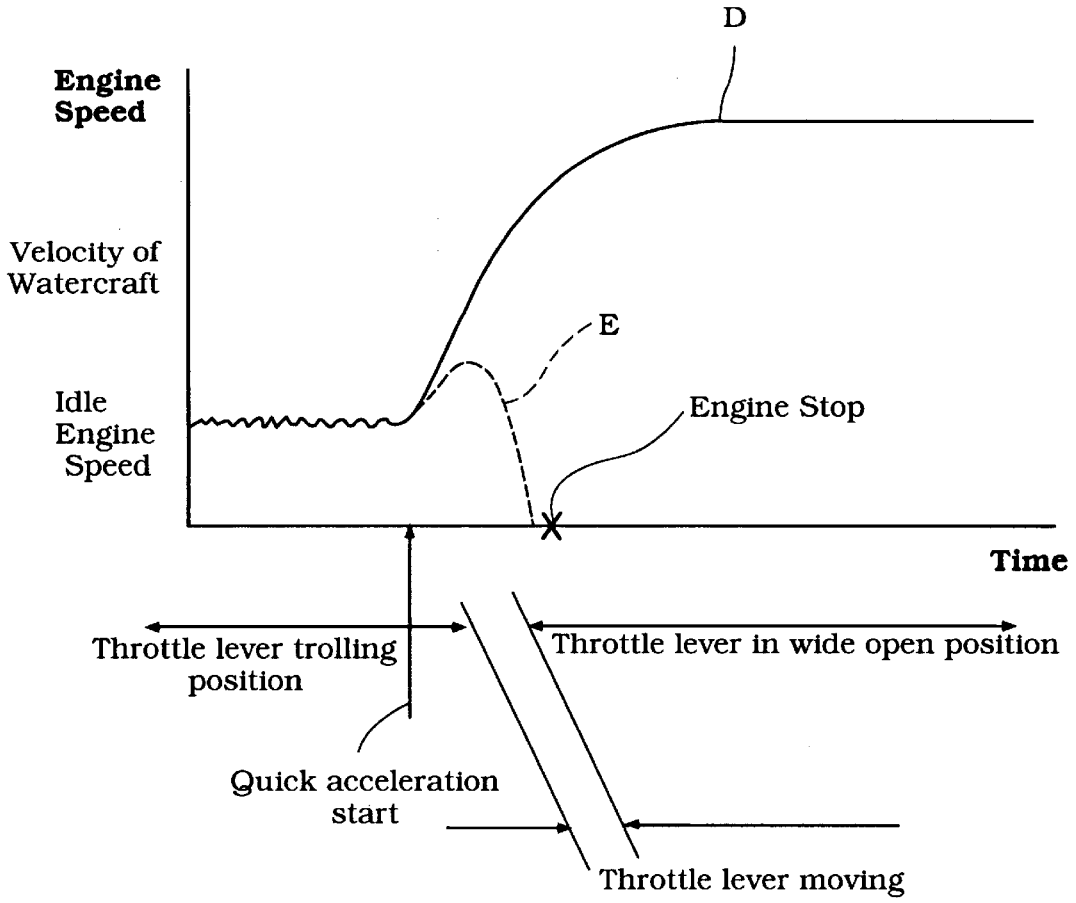
FIG. 3 is a diagram illustrating the characteristic of engine speed versus time and throttle position.

FIG. 3 illustrates how the addition of fuel in accordance with the present invention makes it possible for the engine, and thus the craft, to accelerate even when the fuel delivery rate of the primary fuel delivery system is set very low. The fuel-increasing system of the present invention is used to increase the fuel delivered to the engine while the engine accelerates the craft 20 from idling to its planed position.

Figure 4:
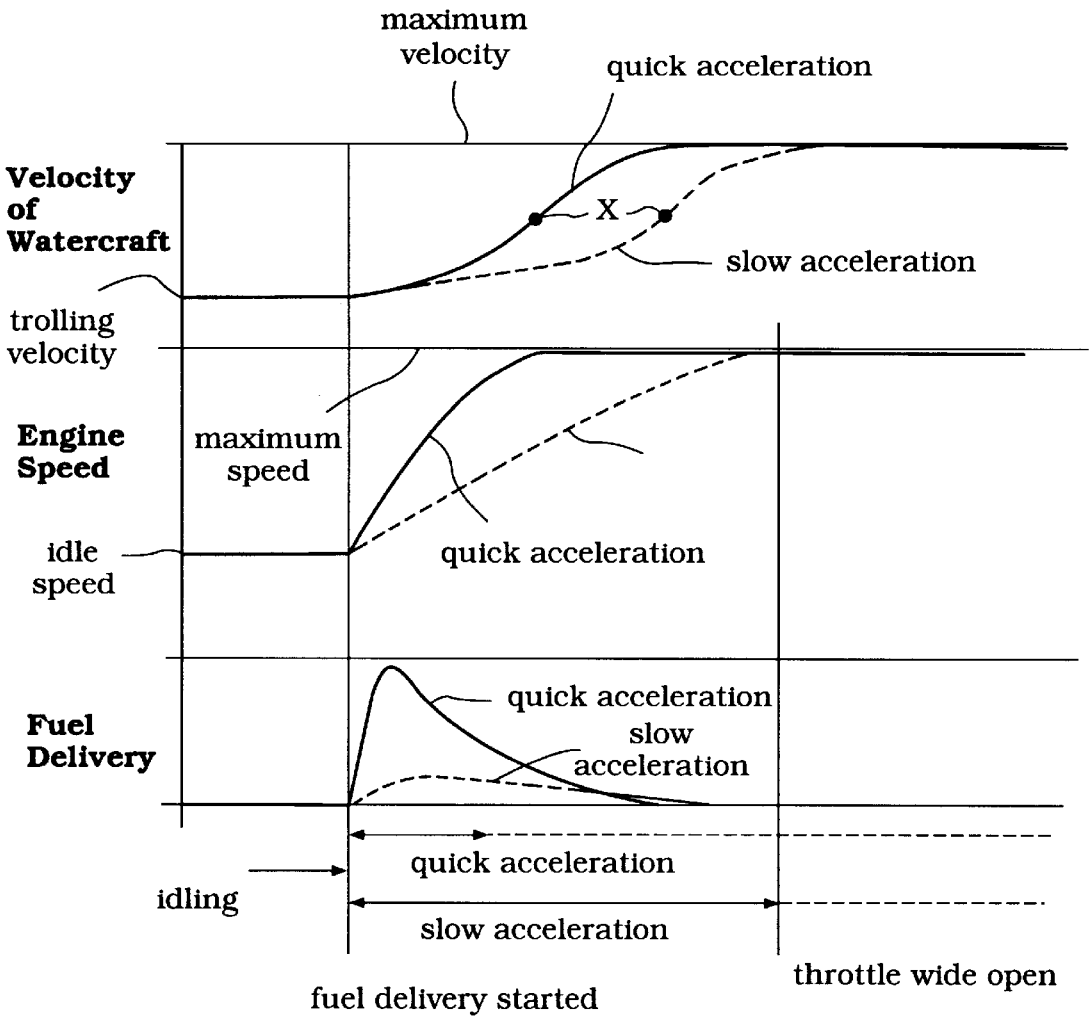
FIG. 4 is a diagram illustrating the characteristics of watercraft velocity, engine speed and fuel delivery versus the throttle position over time.

FIG. 4(*a*) illustrates the velocity of the craft 20 as it relates to the time during which additional fuel is delivered in accordance with the present invention. FIG. 4(*a*) illustrates how increasing the fuel during the proper time permits acceleration of the craft 20 from trolling to a hump velocity (X) at planing; FIG. 4(*b*) relates the engine speed to the addition of fuel with the fuel-increasing system of the present invention. FIG. 4(*c*) illustrates the fuel delivery rate with the fuel-increasing system of the present invention as it relates to throttle position.

Figure 5:
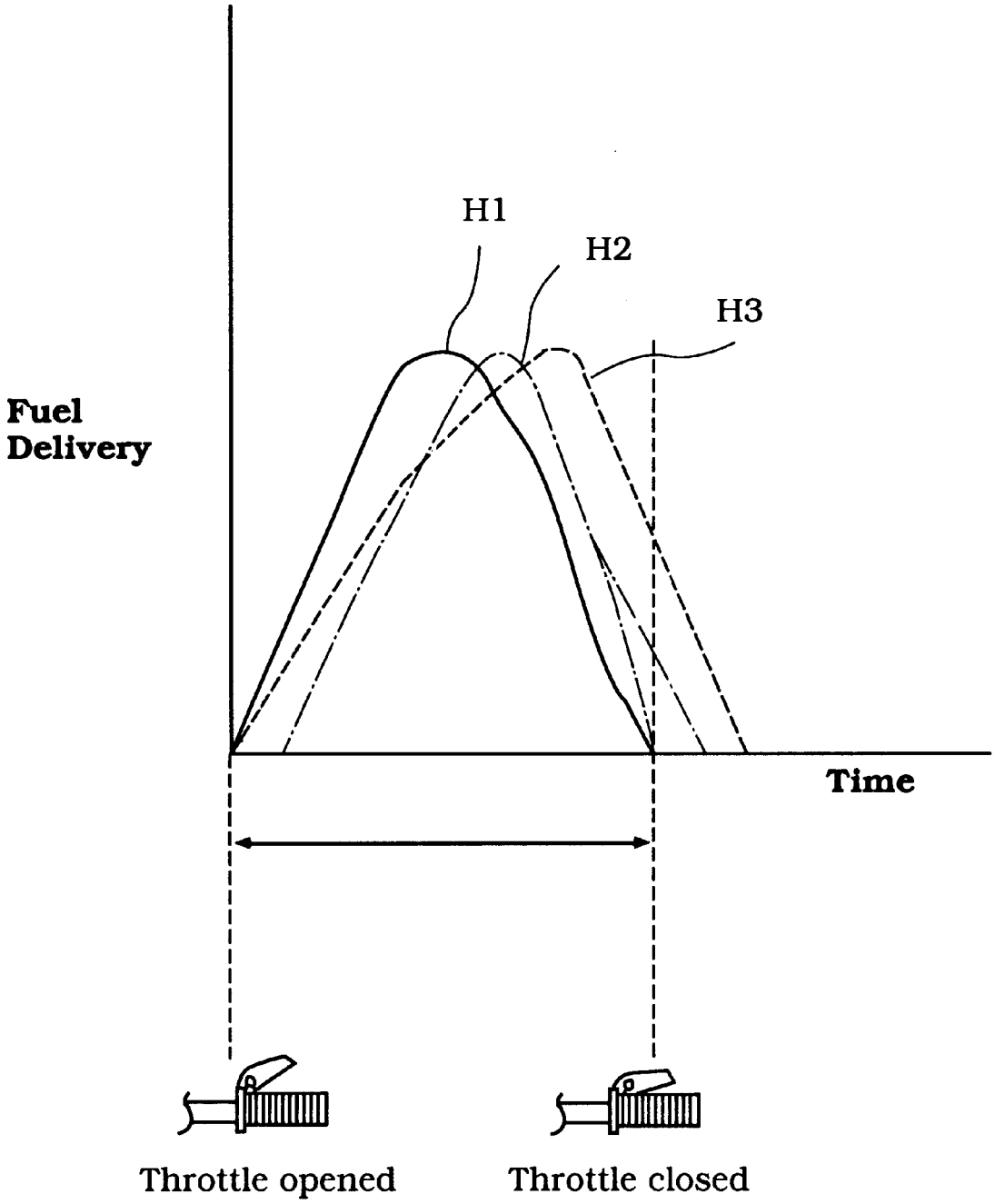
FIG. 5 is a diagram illustrating relationship between additional fuel delivery and throttle position over time.

FIG. 5 illustrates differing periods of time during which additional fuel may be delivered to the engine 30 with the fuel-increasing system of the present invention. First, as illustrated by curve (H), additional fuel may be delivered with the fuel-increasing system commensurate with acceleration, i.e. coincident with the opening and closing of the throttle lever. Alternatively, as illustrated by curve (H2), the fuel-increasing system may be used to begin delivering additional fuel some time after the throttle lever is opened, and continue to deliver the addition fuel for some time after the throttle is closed. Lastly, as illustrated by curve (H3), the fuel-increasing system may be used to begin adding additional fuel at the time the throttle lever is opened, but continue to deliver the additional fuel for some time after the throttle is closed, in order to compensate for mechanical lag time, etc.

In the embodiments of the invention illustrated in FIGS. 6–9, fuel is added to the engine with the fuel-increasing system in direct relationship to the movement of the throttle control. Thus, the secondary source of fuel is added only during the time the throttle is opened in these embodiments.

As illustrated in FIG. 2, however, and as described in conjunction with FIG. 5, it is possible to change the timing of the fuel addition. Referring to FIG. 2, an acceleration detector means (B) may be positioned between the throttle control (A) and the fuel-increasing system (C) of the present invention. For example, the acceleration detector means (B) may detect the position of the throttle (A). If the throttle (A) is moved a given amount (i.e. opened a certain distance corresponding to a desired amount of acceleration), the acceleration detector means (B) may actuate the fuel-increasing system of the present invention, such as by activating a servo-motor which moves the actuator or other control member which effectuates opening of the valve on the second fuel line. In this arrangement, the acceleration detector means (B) may be designed to actuate the fuel-increasing system commensurate in time with the movement of the throttle control (A), or delay the addition of fuel after the throttle is opened or extend the addition of fuel after the throttle is closed.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. An engine comprising an engine block having at least one combustion chamber with a piston movably mounted therein, an intake for an air/fuel mixture, a throttle for controlling the amount of air/fuel mixture introduced into said combustion chamber, and a carburetor comprising an air flow path extending therethrough in communication with said intake of said engine, a fuel pump formed in said carburetor for pumping fuel from a fuel source through a delivery check valve to a fuel delivery chamber formed in said carburetor, a diaphragm operated main control valve downstream of said delivery check valve for controlling the delivery of fuel to said fuel delivery chamber, a first fuel discharge source including a first fuel line extending from said fuel delivery chamber to said air flow path for delivering fuel thereto, and a second fuel source for providing an additional amount of fuel to said engine, said second fuel source comprising a second fuel line communicating said fuel delivery chamber with said air flow path, and an enrichment valve for controlling the flow of fuel through said second fuel line.

2. The engine in accordance with claim 1, further including means for moving said enrichment valve in response to movement of said throttle.

3. The engine in accordance with claim 2, including means for biasing said enrichment valve into a first position in which said enrichment valve closes said second fuel line, said means for moving arranged to move said enrichment valve into a second position in which said second line is opened.

4. The engine in accordance with claim 1, wherein said fuel delivery chamber has a top end and a bottom end and said second fuel line extends from said chamber near said bottom end thereof.

5. The engine in accordance with claim 1 arranged to power a watercraft wherein the valve is opened when said watercraft is accelerating to a planed condition.

6. An engine comprising an engine block having at least one combustion chamber with a piston movably mounted therein, an intake for an air/fuel mixture, a throttle for controlling the amount of air/fuel mixture introduced into said combustion chamber, and a carburetor comprising an air flow path extending therethrough in communication with said intake of said engine, a fuel pump formed in said carburetor for pumping fuel from a fuel source to a fuel delivery chamber formed in said carburetor, a first fuel discharge source extending from said fuel delivery chamber to said air flow path for delivering fuel thereto, and a second fuel source for providing an additional amount of fuel to said engine, said second fuel source comprising a second fuel line communicating said fuel delivery chamber with said air flow path, and a valve for controlling the flow of fuel through said second fuel line, said valve having a first end selectively positionable within said second fuel line and a second end positioned within said fuel delivery chamber, and an arm positioned adjacent said second end of said valve and arranged to move said valve in response to movement of said throttle.

7. The engine in accordance with claim 6, wherein the fuel pump delivers the pumped fuel to a main fuel delivery line extending to said fuel delivery chamber, and further including a main valve for selectively opening and closing said main fuel delivery line.

8. The engine in accordance with claim 7, wherein said main valve is connected to said arm.

9. The engine in accordance with claim 8, wherein said arm has a first end and a second end and a pivot connection to said carburetor therebetween, said main valve connected to said first end and said second end of said arm arranged to engage said valve of said second fuel line.

10. The engine in accordance with claim 6, including means for moving said valve, said means for moving arranged to move said arm when said throttle is moved from a position corresponding to a closed to an open position.

* * * * *